US009827471B1

(12) United States Patent
Wang

(10) Patent No.: US 9,827,471 B1
(45) Date of Patent: Nov. 28, 2017

(54) GOLF BAG ABLE TO BE DISASSEMBLED AND ASSEMBLED FREELY

(71) Applicant: Qiong Wang, Honghu (CN)

(72) Inventor: Qiong Wang, Honghu (CN)

(73) Assignee: Shenzhen Aobao Plastic Co., Ltd, Pingshan New District, Shenzhen (CN)

( * ) Notice: Subject to any disclaimer, the term of this patent is extended or adjusted under 35 U.S.C. 154(b) by 0 days.

(21) Appl. No.: 15/170,998

(22) Filed: Jun. 2, 2016

(30) Foreign Application Priority Data

May 12, 2016 (CN) ..... 2016 1 0316356

(51) Int. Cl.
*A63B 55/00* (2015.01)
*A63B 55/57* (2015.01)

(52) U.S. Cl.
CPC ..... *A63B 55/57* (2015.10)

(58) Field of Classification Search
CPC ..... A45C 55/00; A45C 55/04; A45C 55/40; A63B 55/00; A63B 55/04; A63B 55/40
USPC ..... 206/315.7, 315.8, 315.6
See application file for complete search history.

(56) References Cited

U.S. PATENT DOCUMENTS 5,769,220 A * 6/1998 Hong ..... A63B 55/00 206/315.3
5,772,024 A * 6/1998 Lueders ..... A63B 55/00 206/315.3
5,788,071 A * 8/1998 Shiao ..... A63B 55/00 206/315.3
5,941,383 A * 8/1999 Cheng ..... A63B 55/00 206/315.3
8,807,337 B2 * 8/2014 Barcik ..... A63B 55/00 206/315.1
2006/0108243 A1 * 5/2006 Tan ..... A63B 55/00 206/315.6
2010/0320105 A1 * 12/2010 Aubery ..... A63B 55/00 206/315.7
2013/0075290 A1 * 3/2013 Chang ..... A63B 55/00 206/315.6
2014/0034527 A1 * 2/2014 Anderson ..... A63B 55/00 206/315.6
2015/0122678 A1 * 5/2015 Engel ..... A63B 55/00 206/315.6
2016/0256754 A1 * 9/2016 Martell ..... A63B 55/40
2016/0325158 A1 * 11/2016 Lin ..... A63B 55/40

* cited by examiner

*Primary Examiner* — Sue A Weaver
(74) *Attorney, Agent, or Firm* — Wayne & Ken, LLC; Tony Hom

(57) ABSTRACT

A golf bag able to be disassembled and assembled freely comprises a head frame, a bag body portion, a supporting stick and a bottom frame, or a folding wall arranged on the bottom frame, a plurality of buckles are attached to the head frame and the bottom frame; when the golf bag is disassembled, just press a hook of an outer wall of the bottom frame, snap a buckle pin, take out a supporting stick, press a hook of an upper end and lower end of the bag body portion, and separate the head frame, the bag body portion and the bottom frame, such that the disassembly of the whole golf bag is completed.

7 Claims, 11 Drawing Sheets

GOLF BAG ABLE TO BE DISASSEMBLED AND ASSEMBLED FREELY

CROSS-REFERENCE TO RELATED APPLICATIONS

This application claims priority to Chinese Patent Application No. 201610316356.5 with a filing date of May 12, 2016, The content of the aforementioned application, including any intervening amendments thereto, is incorporated herein by reference.

TECHNICAL FIELD

The present invention relates to the technical field of fitness and entertainment equipment, more particularly, to a golf bag able to be disassembled and assembled freely.

BACKGROUND OF THE PRESENT INVENTION

Traditional golf bags are made up of a head frame, a bottom frame, and a bag body portion, or are made up of additional two supporting legs and a supporting steel wire besides above parts, a bottom of the bag body portion is open, and combined with a base by assembly of a rivet. In words, traditional golf bags have multiple combination processes and complicate assembly.

In the existing prior art, many golf bags can be transported as semi-finished goods, and many patents are about self assembly and disassembly, their processes are complicate, most head frames and bottom frames are equipped with an accessory frame, but the golf bag is completely assembled by concealed button or locking screw, the golf is an outdoor activity, the screw will become rust when touched water or the screw hole of plastic parts will lose its function when the plastic parts are assembled and disassembled with the screw, so the assembly of these golf bags are hard to be disassembled for the unprofessional.

Chinese Patent No. 03273520.0 discloses a golf bag able to be assembled, disassembled and matched freely, both of the head frame and the bottom frame of the present invention include a second frame, when the head frame is combined with the second frame, it is difficult for unprofessional people to assemble successfully because the head frame is wrapped by cloth; and it is also difficult to be disassembled because its combination device is in the bag body; the bottom frame is arranged in the second frame, the protruding part of the bottom frame cannot be too big because of clearance fit, while in the process of assembly, the bottom frame should be stuffed in the second frame, such that each assembling parts are easily damaged; besides, plastic parts are easy to be affected by climate change because of its properties of heat expansion and cold contraction, and the bottom frame is easily fall off.

The structural design of these products are difficult to be disassembled and assembled, when one part of the golf bag is damaged, unprofessional people cannot disassemble the whole golf bag, such that it must be returned to factory repair or scrapped, which results in the unreasonable utilization of resource and not benefits environmental protection; and users cannot match the bag body portion freely, which leads to resource waste.

The present invention provides a golf bag able to be disassembled and assembled freely aimed at deficiencies of above products.

SUMMARY OF THE PRESENT INVENTION

The purpose of the present invention is to overcome the deficiencies existed in prior art by providing a golf bag able to be disassembled and assembled freely, the golf bag has independent head frame, bag body portion and bottom frame, the bag body can be simply assembled and easily to be disassembled by adopting clear buckles, such that complicated transportation and maintenance procedures are avoided.

Purpose of the present invention can be realized by adopting following technical schemes:

A golf bag able to be disassembled and assembled freely, comprising a head frame, a bag body portion, a supporting stick and a bottom frame, wherein a plurality of holes are arranged on a main wall upper end of the head frame, through which cloth can wrap the main wall upper end of the head frame; a plurality of buckle holes are arranged on a main wall and a reinforcing wall of the head frame; a plurality of buckles are attached to an upper end and lower end of the bag body portion, the buckle is provided with a hook; the buckle of the upper end of the bag body portion passes through the buckle holes between the main wall and reinforcing wall of the head frame, the hook is buckled on the reinforcing wall; a plurality of buckle pin grooves are arranged on the bottom frame, a pair of buckle pin holes and a supporting stick hole are arranged respectively in the buckle pin grooves; an buckle pin is arranged on the buckle pin grooves of the bottom frame; a plurality of hooks are arranged on the outer wall of the bottom frame. The supporting stick passes through the supporting stick hole and rotates the buckle pin, the buckle pin is buckled on the hook of the outer wall of the bottom frame. Press a hook of the outer wall of the bottom frame, snap the buckle pin, take out the supporting stick, press the hook of the upper end and lower end of the bag body portion, and separate the head frame, the bag body portion and the bottom frame. Two sides of the reinforcing wall of the head frame are provided with two lugs, which are connected to a back strap respectively; the head frame or bottom frame can be any shape.

Furtherly, a golf bag able to be disassembled and assembled freely, comprising a head frame, a bag body portion, a supporting stick and a bottom frame, wherein a plurality of holes are arranged on a main wall upper end of the head frame, through which cloth can wrap the main wall upper end of the head frame; a plurality of buckle holes are arranged between a main wall and a reinforcing wall of the head frame; a plurality of buckles are attached to an upper end of the bag body portion, the buckles are provided with a hook; the buckles of the upper end of the bag body portion pass through the buckle holes between the main wall and reinforcing wall of the head frame, the hook is buckled on the reinforcing wall; a plurality of buckles and cloth ears are arranged on a lower end of the bag body portion, one end of the cloth ear is provided with a hole; a groove is arranged between an inner wall and outer wall of the bottom frame, a plurality of buckle holes are opened between the grooves, the buckles of the lower end of the bag body portion pass through the buckle holes between the inner wall and outer wall of the bottom frame, the hook is buckled on the outer wall; a plurality of buckle pin grooves are arranged on the bottom frame, a pair of buckle pin holes and a supporting stick hole are arranged respectively in the buckle pin grooves; an buckle pin is arranged on the buckle pin grooves of the bottom frame; a plurality of hooks are arranged on the outer wall of the bottom frame. The supporting stick passes through the supporting stick hole and hole on the cloth ear of the lower end of the bag body portion, and rotates the buckle pin, the buckle pin is buckled on the hook of the outer wall of the bottom frame. Press the hook of the outer wall of the bottom frame, snap the buckle pin, disassemble the cloth ear, take out the supporting stick, press the hook of the upper end and lower end of the bag body portion, and separate the head frame, the bag body portion and the bottom frame. Two sides of the reinforcing wall of the head frame are provided with two lugs, which are connected to a back strap respectively; the head frame or bottom frame can be any shape.

Based on above golf bags able to be disassembled and assembled freely, a folding wall can be arranged on one end of the bottom frame, and two supporting legs are attached to one end of the head frame, a supporting steel wire is arranged between the supporting legs and the bottom frame, by folding the folding wall, two supporting legs can be opened freely and used as a stand.

Compared with the prior art, the beneficial effects of the present invention are style of the head frame and color of the cloth can be easily changed, a new product can be made by changing the bag body portion only, or if one part is damaged, press the hook of the outer wall of the bottom frame, snap the buckle pin, take out the supporting stick, press the hook on the bag body portion and separate the bottom frame, bag body portion or head frame; the bottom frame, bag body portion or head frame independently of each other can be repaired or purchased independently, the damaged parts are changed to ensure the recycling of golf bag, which avoids resource waste and benefits environmental protection; besides, a folding wall is arranged on one end of the bottom frame, and two supporting legs connected on the supporting steel wire are attached to one end of the head frame, by folding the folding wall, two supporting legs can be opened freely and used as a stand.

In which: 60—head frame; 66—bag body portion; 68—bottom frame; 69—supporting stick; 70—buckle pin; 110—buckle; 112—cloth ear; 100—main wall; 101—reinforcing wall; 102—upper end of the main wall; 103—hole of main wall upper end; 104—buckle hole; 105—inner wall of main wall; 134—lug; 136—hole on lug; 106—cloth; 107—cloth ear on an upper end of the cloth; 108—lower end of the cloth; 109—lower end of the main wall; A: hook; 113—hole on the cloth ear; 135—back strap; 118—inner wall; 119—outer wall; 120—groove; 121—buckle hole of the bottom frame; 122—outer side of the outer wall; 123—hook; 125—supporting stick hole; 126—hole for fixing the buckle pin; 127—hole for fixing the buckle pin; 133—buckle pin groove; 132—bottom of the groove; 70—buckle pin; 128—rotating shaft; 129—rotating shaft; 130—bottom hole; 131—hook hole; 137—folding wall; 138—thin wall; 71—supporting leg; 72—supporting steel wire.

DETAILED DESCRIPTION OF PREFERRED EMBODIMENTS

Embodiment 1

Figure 1:
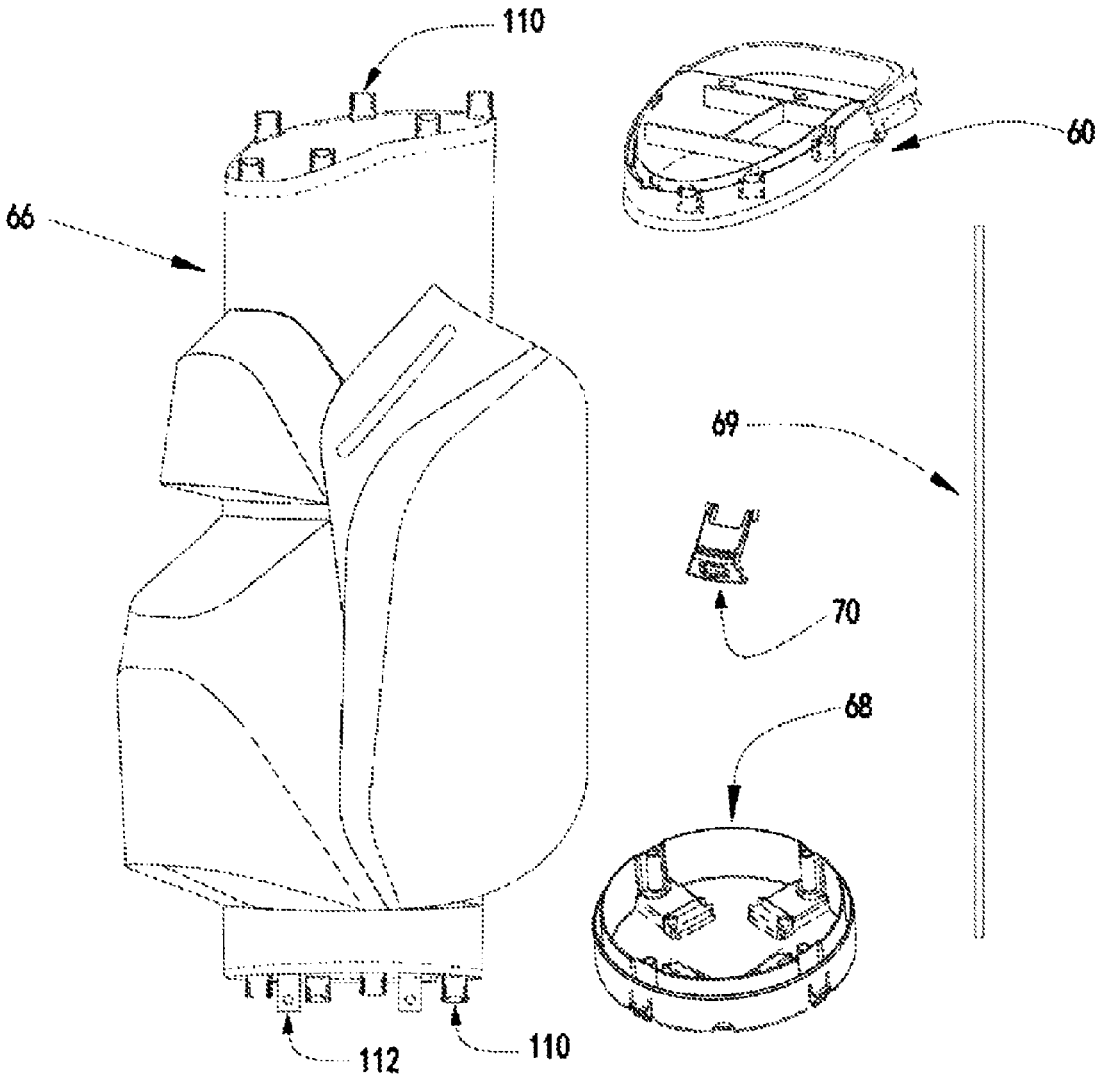
FIG. 1 is an exploded view of the golf bag able to be disassembled and assembled freely in embodiment 1.
Figure 2A:
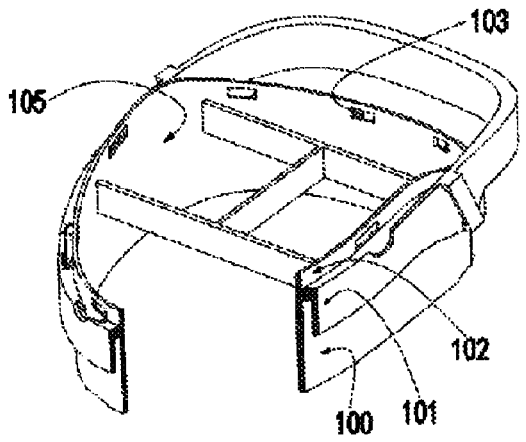
FIG. 2A is a perspective view of a head frame of the golf bag able to be disassembled and assembled freely in embodiment 1 and 2.
Figure 2B:
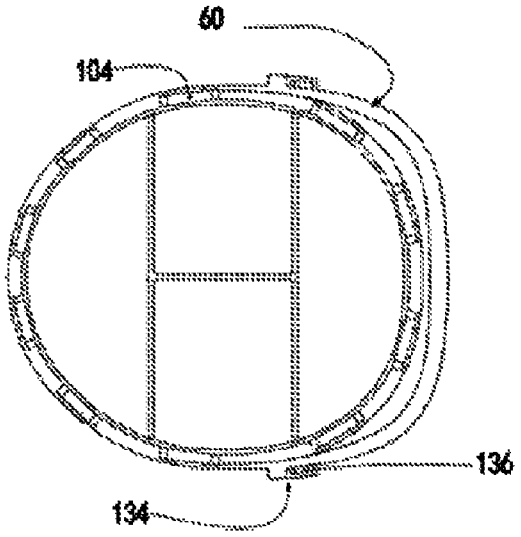
FIG. 2B is a top view of a head frame of the golf bag able to be disassembled and assembled freely in embodiment 1 and 2.
Figure 2C:
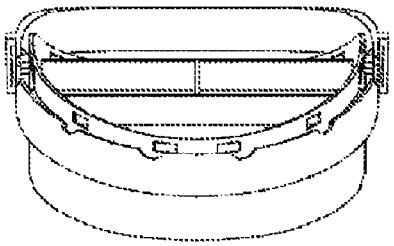
FIG. 2C is a side view of a head frame of the golf bag able to be disassembled and assembled freely in embodiment 1 and 2.
Figure 2D:
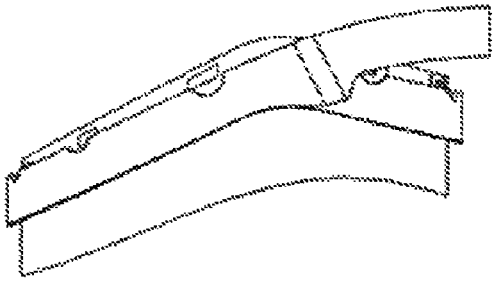
FIG. 2D is a front view of a head frame of the golf bag able to be disassembled and assembled freely in embodiment 1 and 2.

As FIG. 1 shown, the present invention is made up of a head frame 60, a bag body portion 66, a bottom frame 68, a supporting stick 69, a buckle pin 70, a buckle 110 and a cloth ear 112;

As shown in FIGS. 1, 2A, 2B, 2C, 2D and 5, a main wall 100, a reinforcing wall 101 located outside of the main wall, an upper end of the main wall 102 are respectively located on the head frame 60; a plurality of holes 103 are arranged on the upper end of the main wall 102, a plurality of buckle holes 104 are arranged between the upper end of the main wall 102 and the reinforcing wall 101, a buckle 110 of an upper end of a bag body portion 66 passes through the buckle hole 104 from bottom to top, a hook A is arranged on the buckle 110, the hook A is stuck in an upper edge of the reinforcing wall 101.

The buckle 110 and the bag body portion 66 are fixed by sewing; when the bag body portion 66 is combined with the head frame 60, a plurality of buckles 110 of the upper end of the bag body portion 66 are inserted into a plurality of buckle holes 104 of the head frame 60 one-to-one correspondingly, such that the hook A can be buckled on the reinforcing wall 101, and the bag body portion 66 can be fixed with the head frame 60 by the buckle 110; besides, the buckle 110 is arranged between the main wall 100 and the reinforcing wall 101, such that the connection between the bag body portion and the head frame is further fixed, and the buckle 110 is not easily fall off.

Figure 3:
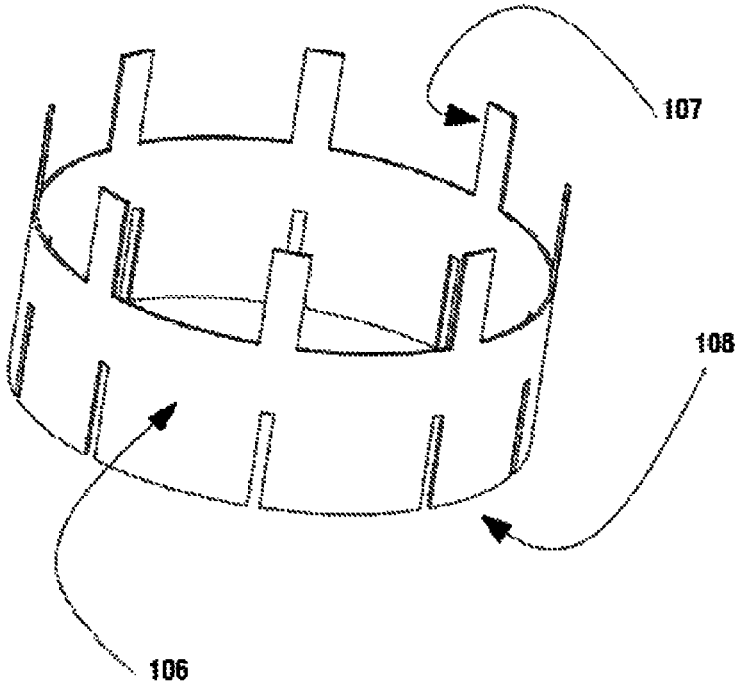
FIG. 3 is a schematic diagram of head frame cloth of the golf bag able to be disassembled and assembled freely in embodiment 1 and 2.
Figure 4:
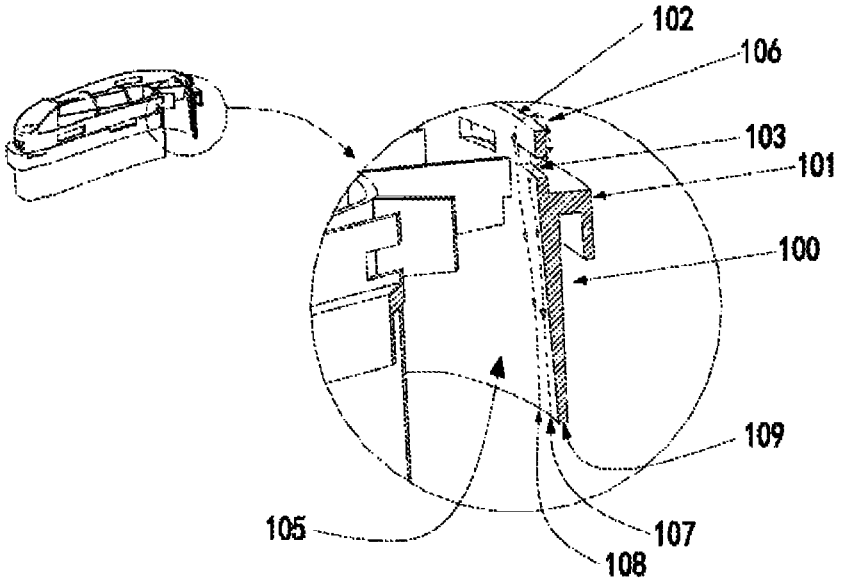
FIG. 4 is a use state diagram of the head frame wrapping cloth of the golf bag able to be disassembled and assembled freely in embodiment 1 and 2.
Figure 5:
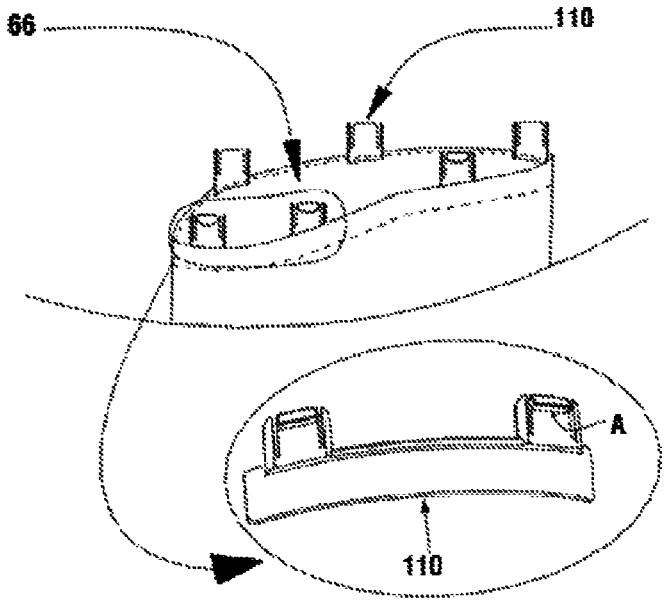
FIG. 5 is a schematic diagram of a buckle of the golf bag able to be disassembled and assembled freely in embodiment 1 and 2.

As FIG. 3 and FIG. 4 shown, an inner wall of the main wall 105 and a lower end of the main wall 109 are respectively located on the head frame 60, when the upper end of the main wall 102 of the head frame 60 is wrapped by cloth, cloth ears 107 of an upper end of the cloth 106 are inserted into holes 103 of the upper end of the main wall 102 one-to-one correspondingly, and enter the inner wall of the main wall 105 via the hole 103, bypassing the upper end of the main wall 102 and the inner wall of the main wall 105, a lower end 108 of the cloth and the upper end cloth ears 107 are aligned by pulling downwards, the upper end 107 and lower end 108 of the cloth are fixed on the lower end of the main wall 109 buy sewing. The style of the head frame 60 can be various by changing style of the cloth 106.

As shown in FIGS. 2A, 2B, 2C, 2D and 7, two sides of the reinforcing wall 101 of the head frame are provided with two lugs 134, a hole 136 is arranged on the lug 134, a back strap 135 passes through the hole 136 on the lug, such that the head frame 60 and the back strap 135 can be connected firmly.

Figure 6:
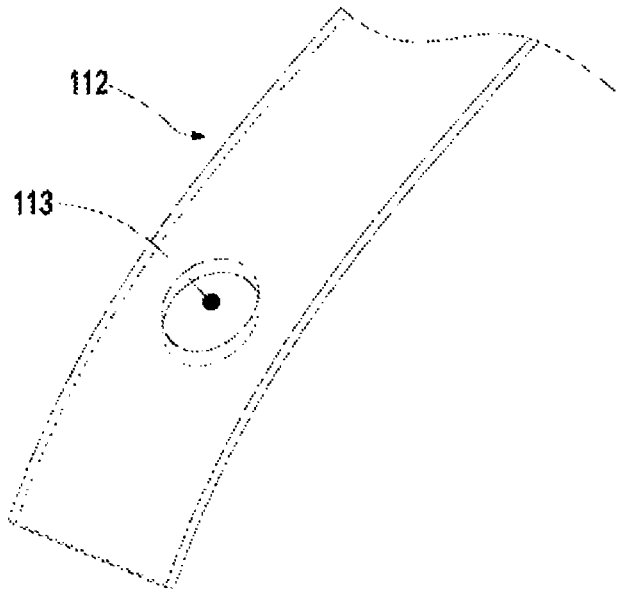
FIG. 6 is a schematic diagram of a cloth ear on a bag body portion of the golf bag able to be disassembled and assembled freely in embodiment 1 and 2.
Figure 7:
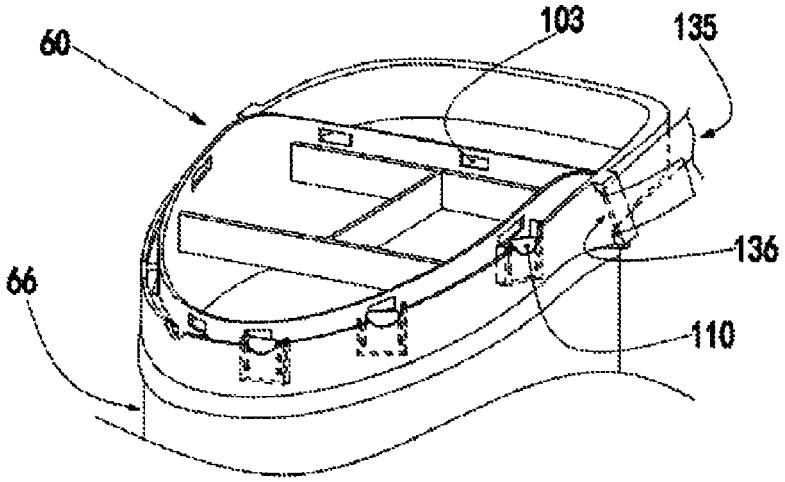
FIG. 7 is a schematic diagram of a head frame lug of the golf bag able to be disassembled and assembled freely in embodiment 1 and 2.
Figure 8A:
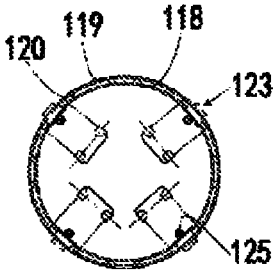
FIG. 8A is a top view of a bottom frame of the golf bag able to be disassembled and assembled freely in embodiment 1 and 2.
Figure 8B:
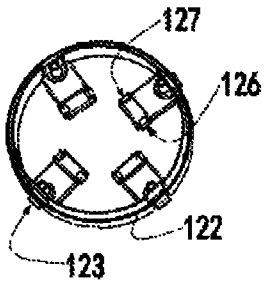
FIG. 8B is a perspective view of a bottom frame of the golf bag able to be disassembled and assembled freely in embodiment 1 and 2.
Figure 8C:
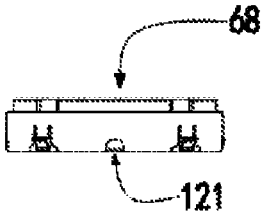
FIG. 8C is a front view of a bottom frame of the golf bag able to be disassembled and assembled freely in embodiment 1 and 2.
Figure 8D:
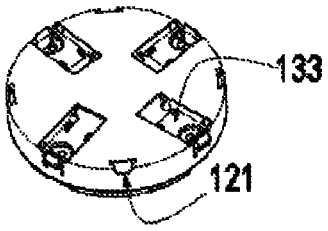
FIG. 8D is a perspective view of a bottom frame of the golf bag able to be disassembled and assembled freely in embodiment 1 and 2 from a different perspective.
Figure 9:
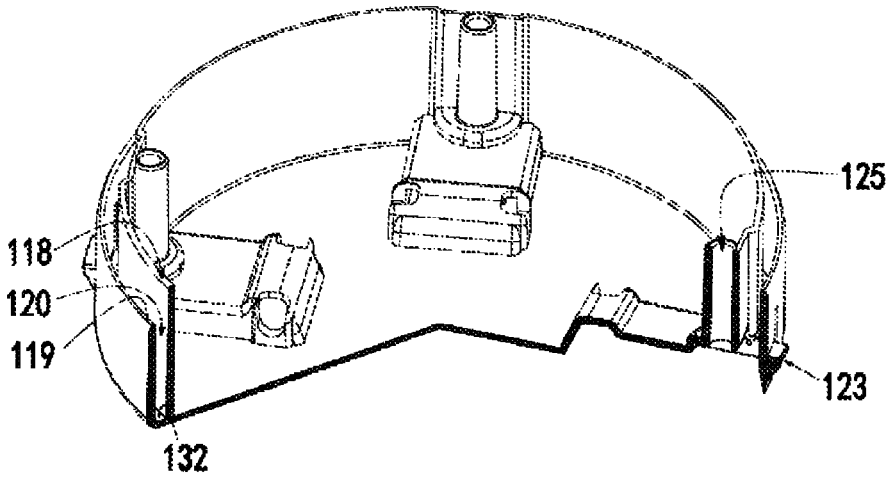
FIG. 9 is a section view of a bottom frame of the golf bag able to be disassembled and assembled freely in embodiment 1 and 2.
Figure 10A:
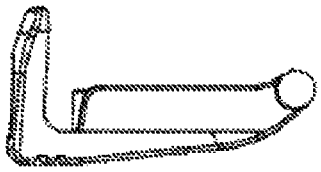
FIG. 10A is a front view of a buckle pin of the golf bag able to be disassembled and assembled freely in embodiment 1 and 2.
Figure 10B:
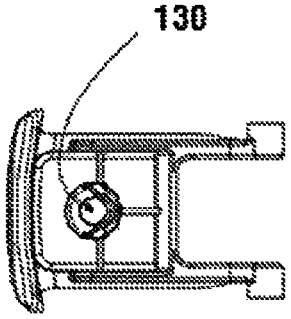
FIG. 10B is a top view of a buckle pin of the golf bag able to be disassembled and assembled freely in embodiment 1 and 2.
Figure 10C:
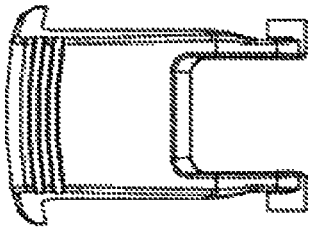
FIG. 10C is a bottom view of a buckle pin of the golf bag able to be disassembled and assembled freely in embodiment 1 and 2.
Figure 10D:
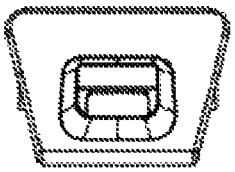
FIG. 10D is a side view of a buckle pin of the golf bag able to be disassembled and assembled freely in embodiment 1 and 2.
Figure 10E:
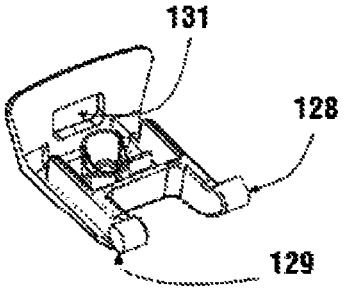
FIG. 10E is a perspective view of a buckle pin of the golf bag able to be disassembled and assembled freely in embodiment 1 and 2.
Figure 10F:
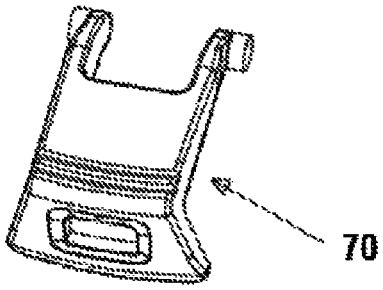
FIG. 10F is a perspective view of a buckle pin of the golf bag able to be disassembled and assembled freely in embodiment 1 and 2 from a different perspective.
Figure 11A:
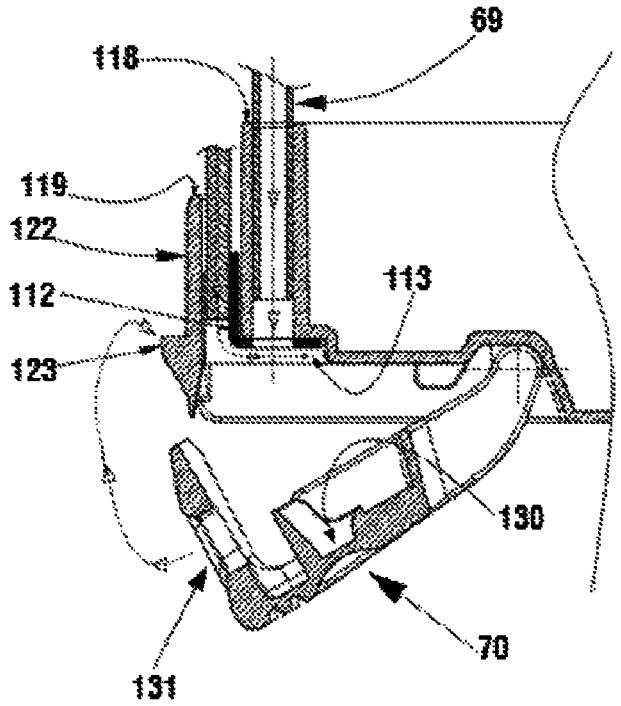
FIG. 11A shows a cloth ear of a bag body portion, a supporting stick, a buckle pin and a bottom frame of the golf bag able to be disassembled and assembled freely in embodiment 1, wherein the buckle pin is disengaged from the outer wall of the bottom frame.
Figure 11B:
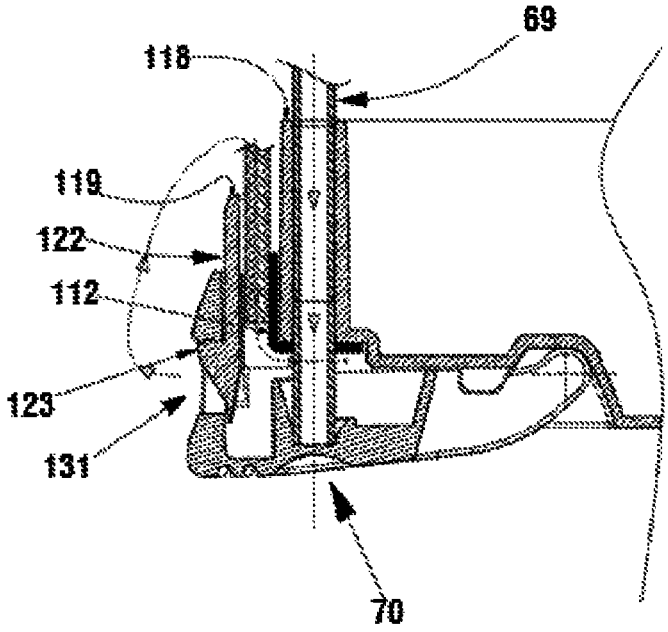
FIG. 11B shows a cloth ear of a bag body portion, a supporting stick, a buckle pin and a bottom frame of the golf bag able to be disassembled and assembled freely in embodiment 1, wherein the buckle pin is buckled on the outer wall of the bottom frame.

As FIG. 1 and FIG. 6 shown, the lower end of the bag body portion 66 is connected with the bottom frame 68, the cloth ear 112 is fixed on the lower end of the bag body portion 66 by sewing, a hole 113 is arranged on one end of the cloth ear 112.

As shown in FIGS. 1,8A, 8B, 8C and 8D, a plurality of grooves 133 for assembling a buckle pin 70 on the bottom frame 68, a pair of holes 126, 127 fox fixing the buckle pin 70 and a supporting stick hole 125 for fixing a supporting stick 69 are arranged in the groove 133 of the buckle pin.

As shown in FIGS. 1,8A, 8B, 8C, 8D and 9, an inner wall 118 and an outer wall 119 are arranged on the bottom frame 68, a plurality of hooks 123 are arranged around the outer side 122 of the outer wall 119; a groove 120 is arranged between the inner wall 118 and the outer wall 119, a plurality of buckle holes 121 are arranged on the bottom of the groove 132, when the buckle 110 of the lower end of the bag body portion 66 is inserted into the buckle hole 121, the buckle hole 121 is in the groove 120 of the bottom frame 68, which further ensures the buckle 110 is not easily compressed and fall off. When the buckle 110 passes through the buckle hole 121 on the groove 120 and is buckled on the outer wall 119 reversely, the groove 120 fixes the buckle 110 between the inner wall 118 and outer wall 119 firmly, and protects the buckle not easily fall off, such that the whole bag body is stable.

As shown in FIGS. 8A, 8B, 8C, 8D, and 10A, 10B, 10C, 10D, 10E, 10F and 11, a group of rotating shafts 128, 129 are arranged on one end of the buckle pin 70, a bottom hole 130 is arranged in the middle of the buckle pin 70 for fixing the supporting stick 69, a hook hole 131 is arranged on the other end. When the bottom frame 68 is combined with the buckle pin 70, the rotating shafts 128, 129 of the buckle pin 70 are inserted into the buckle pin holes 126, 127 respectively, such that the buckle pin 70 can rotate freely up and down in the buckle pin holes 126, 127.

As shown in FIGS. 1, 5, 8A, 8B, 8C, 8D and 11, when the bottom frame 68, the supporting stick 69 are combined with the bag body portion 66, a plurality of buckles 110 of the lower end of the bag body portion are inserted into a plurality of buckle holes 121 on the groove of the bottom frame 120, the hook A on the buckle 110 is buckled on the outer wall 119; then the supporting stick 69 passes through the supporting stick hole 125 of the bottom frame 68, and the hole 113 on the cloth ear 112 passes through the supporting stick correspondingly, snap the buckle pin 70, such that bottom hole 130 of the buckle pin can engage a bottom end of the supporting stick respectively and correspondingly, and the hook hole 131 on the buckle pin 70 is buckled on the hook 123 of the outer wall 119 of the bottom frame respectively, in this way, the supporting stick 69 is firmly fixed, and the whole golf bag is easily assembled.

When it needs to be disassembled, press a hook 123 of the outer wall 119 of the bottom frame, snap the buckle pin 70, disassemble the cloth ear 112, take out the supporting stick 69; press the hook A of the upper end and lower end of the bag body portion 66, and the head frame 60, the bag body portion 66, the supporting stick 69 and the bottom frame 68 can be easily disassembled.

The head frame 60 or the bottom frame 68 can be any shape, like circular, oval, rhombic and square shape.

Embodiment 2

Figure 12:
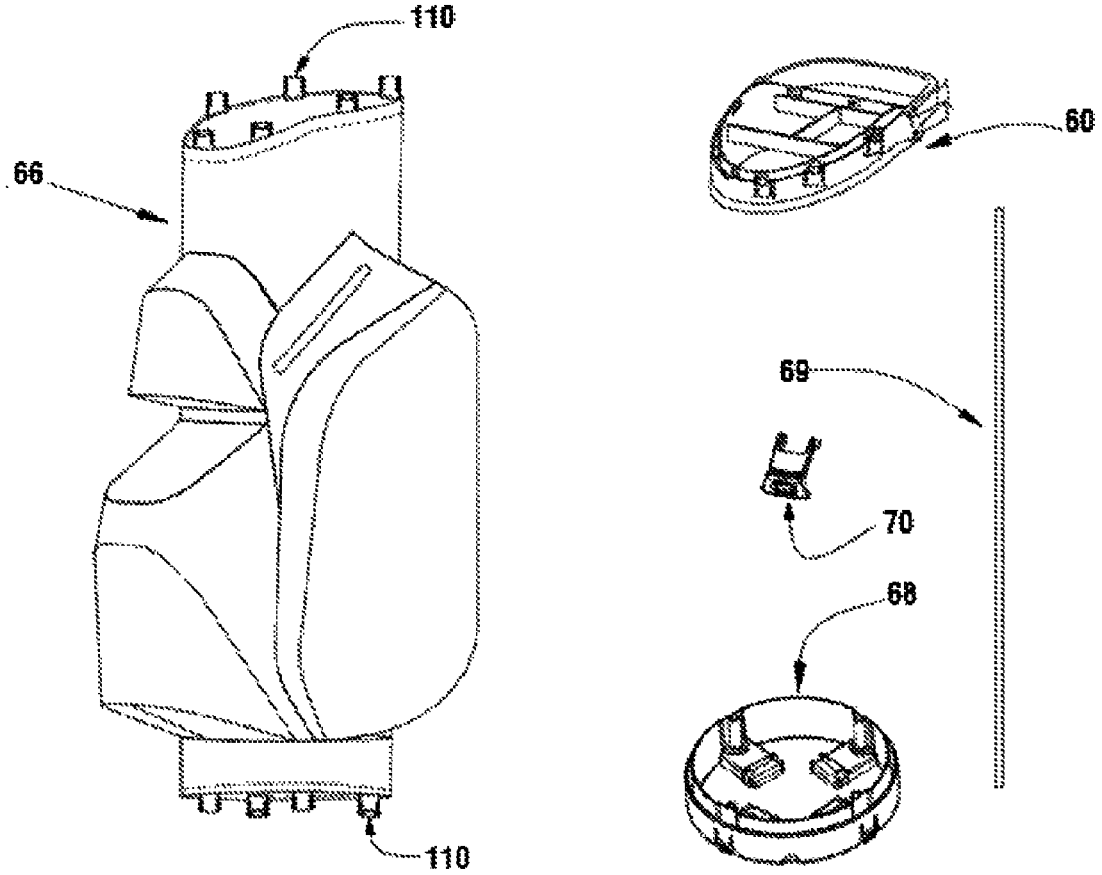
FIG. 12 is an exploded view of the golf bag able to be disassembled and assembled freely in embodiment 2.
Figure 13A:
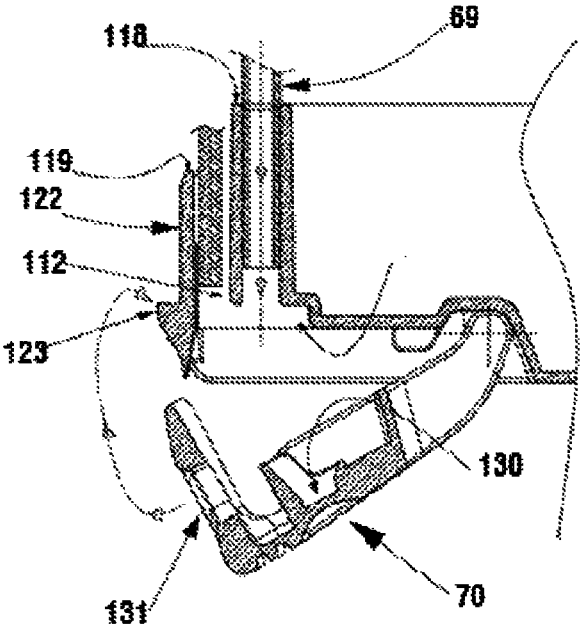
FIG. 13A shows a bag body portion, a supporting stick, a buckle pin and a bottom frame of the golf bag able to be disassembled and assembled freely in embodiment 2, wherein the buckle pin is disengaged from the outer wall of the bottom frame.
Figure 13B:
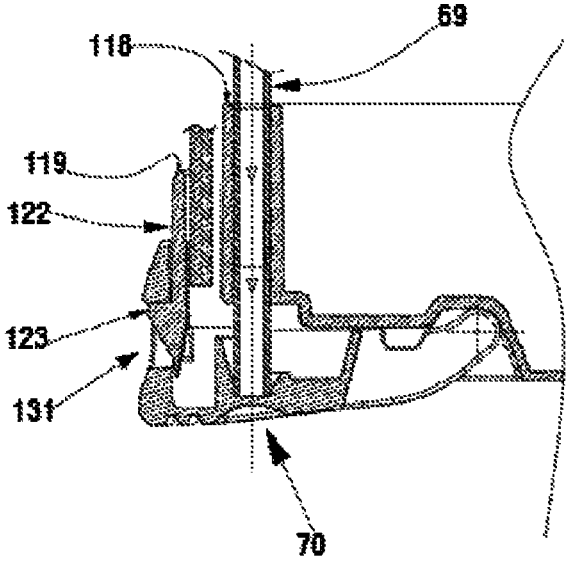
FIG. 13B shows a bag body portion, a supporting stick, a buckle pin and a bottom frame of the golf bag able to be disassembled and assembled freely in embodiment 2, wherein the buckle pin is buckled on the outer wall of the bottom frame.
Figure 14A:
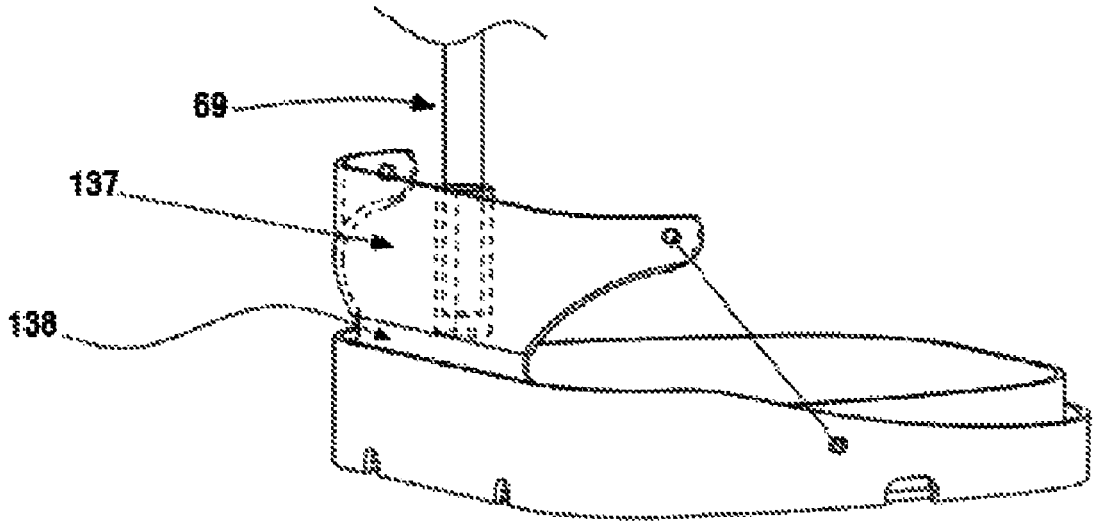
FIG. 14A shows a folding wall of a bottom frame of the golf bag able to be disassembled and assembled freely in embodiment 3.
Figure 14B:
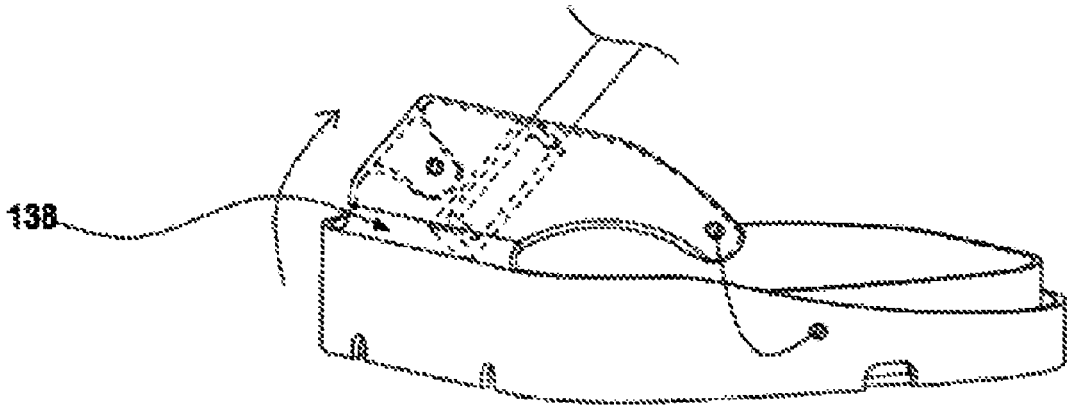
FIG. 14B shows a folding wall of a bottom frame of the golf bag able to be disassembled and assembled freely in embodiment 3 with the thin wall bended.
Figure 15A:
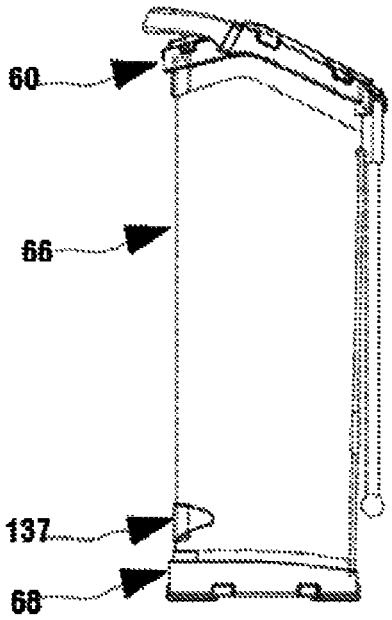
FIG. 15A is a front view of the golf bag able to be disassembled and assembled freely with a bracket in embodiment 3.
Figure 15B:
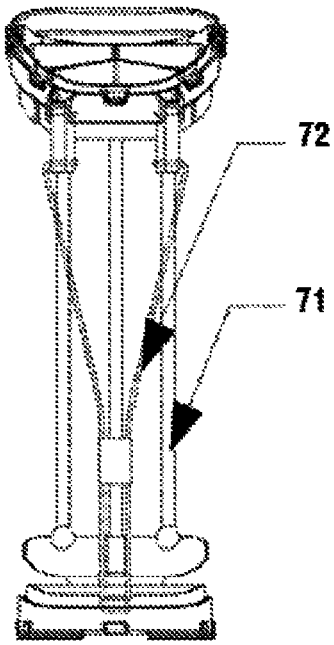
FIG. 15B is a side view of the golf bag able to be disassembled and assembled freely with a bracket in embodiment 3.
Figure 15C:
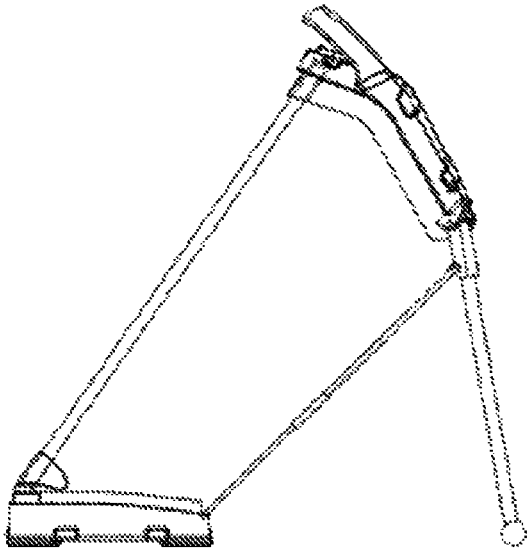
FIG. 15C shows the golf bag able to be disassembled and assembled freely with a bracket in embodiment 3 which is used as a stand bag.

The difference with embodiment 1 is all cloth ears of the lower end of the bag body portion is replaced, only buckles are arranged for this golf bag able to be disassembled and assembled freely, as FIG. 12 shown, this golf bag is made up of a head frame 60, a bag body portion 66, a bottom frame 68, a supporting stick 69, a buckle pin 70 and a buckle 110.

As shown in FIGS. 2A, 2B, 2C, 2D, 5 and 12, a main wall 100, a reinforcing wall 101 located outside of the main wall, an upper end of the main wall 102 are respectively located on the head frame 60; a plurality of holes 103 are arranged on the upper end of the main wall 102, a plurality of buckle holes 104 are arranged between the upper end of the main wall 102 and the reinforcing wall 101, a buckle 110 of an upper end of a bag body portion 66 passes through the buckle hole 104 from bottom to top, a hook A is arranged on the buckle 110, the hook A is stuck in an upper edge of the reinforcing wall 101.

The buckle 110 and the bag body portion 66 are fixed by sewing; when the bag body portion 66 is combined with the head frame 60, buckles 110 of the upper end of the bag body portion 66 are inserted into the buckle holes 104 of the head frame 60 one-to-one correspondingly, such that the hook A can be buckled on the reinforcing wall 101, and the bag body portion 66 can be fixed with the head frame 60 by the buckle 110; besides, the buckle 110 is arranged between the main wall 100 and the reinforcing wall 101, such that the connection between the bag body portion and the head frame is further fixed, and the buckle 110 is not easily fall off.

As FIG. 3 and FIG. 4 shown, an inner wall of the main wall 105 and a lower end of the main wall 109 are respectively located on the head frame 60, when the upper end of the main wall 102 of the head frame 60 is wrapped by cloth, cloth ears 107 of an upper end of the cloth 106 are inserted into holes 103 of the upper end of the main wall 102 one-to-one correspondingly, and enter the inner wall of the main wall 105 via the hole 103, bypassing the upper end of the main wall 102 and the inner wall of the main wall 105, a lower end 108 of the cloth and the cloth ears 107 of the upper end are aligned by pulling downwards, the upper end 107 and lower end 108 of the cloth are fixed on the lower end of the main wall 109 buy sewing. The style of the head frame 60 can be various by changing style of the cloth 106.

As shown in FIGS. 2A, 2B, 2C, 2D and 7, two sides of the reinforcing wall 101 of the head frame are provided with two lugs 134, a hole 136 is arranged on the lug 134, a back strap 135 passes through the hole 136 of the lug, such that the head frame 60 and the back strap 135 can be connected firmly.

As shown in FIGS. 8A, 8B, 8C, 8D and 12, a plurality of grooves 133 for assembling a buckle pin 70 on the bottom frame 68, a pair of holes 126, 127 fox fixing the buckle pin 70 and a supporting stick hole 125 for fixing a supporting stick 69 are arranged in the groove 133 of the buckle pin.

As shown in FIGS. 8A, 8B, 8C, 8D, 9 and 12, an inner wall 118 and an outer wall 119 are arranged on the bottom frame 68, a plurality of hooks 123 are arranged around the outer side 122 of the outer wall 119; a groove 120 is arranged between the inner wall 118 and the outer wall 119, a plurality of buckle holes 121 are arranged on the bottom of the groove 132, when the buckle 110 of the lower end of the bag body portion 66 is inserted into the buckle hole 121, the buckle hole 121 is in the groove 120 of the bottom frame 68, which further ensures the buckle 110 is not easily compressed and fall off. When the buckle 110 passes through the buckle hole 121 on the groove 120 and is buckled on the outer wall 119 reversely, the groove 120 fixes the buckle 110 between the inner wall 118 and outer wall 119 firmly, and protects the buckle not easily fall off, such that the whole bag body is stable.

As shown in FIGS. 8A, 8B, 8C, 8D, 10A, 10B, 10C, 10D, 10E, 10F and 13A, 13B, a group of rotating shafts 128, 129 are arranged on one end of the buckle pin 70, a bottom hole 130 is arranged in the middle of the buckle pin 70 for fixing the supporting stick 69, a hook hole 131 is arranged on the other end. When the bottom frame 68 is combined with the buckle pin 70, the rotating shafts 128, 129 of the buckle pin 70 are inserted in the buckle pin holes 126, 127 respectively, such that the buckle pin 70 can rotate freely up and down in the buckle pin holes 126, 127.

As shown in FIGS. 5, 8A, 8B, 8C, 8D, 12 and 13A, 13B, when the bottom frame 68, the supporting stick 69 are combined with the bag body portion 66, a plurality of buckles 110 of the lower end of the bag body portion 66 are inserted into a plurality of buckle holes 121 on the groove of the bottom frame 120, the hook A on the buckle 110 is buckled on the outer wall 119; then the supporting stick 69 passes through the supporting stick hole 125 of the bottom frame 68, and the hole 113 on the cloth ear 112 passes through the supporting stick correspondingly, snap the buckle pin 70, such that bottom hole 130 of the buckle pin can engage a bottom end of the supporting stick respectively and correspondingly, and the hook hole 131 on the buckle pin 70 is buckled on the hook 123 of the outer wall 119 of the bottom frame respectively, in this way, the supporting stick 69 is firmly fixed, and the whole golf bag is easily assembled.

When it needs to be disassembled, press a hook 123 of the outer wall 119 of the bottom frame, snap the buckle pin 70, disassemble the out the supporting stick 69; press the hook A of the upper end and lower end of the bag body portion, and the head frame 60, the bag body portion, the supporting stick 69 and the bottom frame 68 can be easily disassembled.

The head frame 60 or the bottom frame 68 can be any shape, like circular, oval, rhombic and square shape.

Embodiment 3

Based on embodiment 1 and embodiment 2, the golf bag able to be disassembled and assembled freely can be used as a stand bag, as shown in FIGS. 14A, 14B and 15A, 15B and 15C, a foldable folding wall 137 is arranged on one end of the bottom frame 68, and two supporting legs 71 are attached to one end of the head frame, a supporting steel wire is arranged between the supporting legs and the bottom frame, by bending a thin wall 138 on the folding wall, two supporting legs 71 on the supporting steel wire can be opened freely, the supporting legs can be inclined landed and used as a stand, such that the bottom frame can be parallel landed.

The head frame 60 or the bottom frame 68 can be any shape, like circular, oval, rhombic and square shape.

The present invention is not limited to above embodiments for those skilled in the art, and the present invention can be realized by other embodiments without departing from the basic feature of the present invention. So the embodiments are demonstrative, but not restrictive, the similar variations of the features, advantages, and details in processing and manufacturing, especially similar structure and shape, all belong to the protection scope of the present invention.

I claim:

1. A golf bag able to be disassembled and assembled freely, comprising a head frame, a bag body portion, a supporting stick and a bottom frame, characterized in that:

a plurality of holes are arranged on an upper end of a main wall of the head frame, through which a cloth wraps the upper end of the main wall of the head frame; a plurality of buckle holes are arranged between the main wall and a reinforcing wall of the head frame;

a plurality of buckles are attached to an upper end and lower end of the bag body portion, wherein each of the buckles is provided with a first hook;

the buckles of the upper end of the bag body portion passes through the buckle holes between the main wall and reinforcing wall of the head frame, wherein the first hook is fitted with the reinforcing wall;

a groove is arranged between an inner wall and outer wall of the bottom frame, a plurality of buckle holes are arranged between the grooves, wherein the buckles of the lower end of the bag body portion pass through the buckle holes between the inner wall and outer wall of the bottom frame, wherein the first hook is fitted with the outer wall;

a plurality of buckle pin grooves are arranged on the bottom frame, a pair of buckle pin holes and a supporting stick hole are arranged respectively in the buckle pin grooves; the buckle pin is arranged on the buckle pin grooves of the bottom frame and provided with a hook hole; a plurality of second hooks are arranged on the outer wall of the bottom frame;

a folding wall is arranged on one end of the bottom frame, which is used for opening two supporting legs attached to one end of the head frame by bending the folding wall when supporting the golf bag.

2. The golf bag able to be disassembled and assembled freely according to claim 1, wherein the supporting stick passes through the supporting stick hole, and the second hook engages with the hook hole of the buckle pin in snap fit, such that the buckle pin is attached to the outer wall of the bottom frame.

3. The golf bag able to be disassembled and assembled freely according to claim 1, wherein a method of disassembling the golf bag comprises the following steps:

pressing the second hook of the outer wall of the bottom frame; snapping the buckle pin;

taking out the supporting stick;

pressing the first hooks of the upper end and lower end of the bag body portion; and separating the head frame, the bag body portion and the bottom frame.

4. The golf bag able to be disassembled and assembled freely according to claim 1, wherein a plurality of cloth ears are arranged on the lower end of the bag body portion, a hole is arranged on one end of the cloth ear.

5. The golf bag able to be disassembled and assembled freely according to claim 4, wherein the supporting stick passes through the supporting stick hole and the hole on the cloth ear of the lower end of the bag body portion, and the second hook engages with the hook hole of the buckle pin in snap fit, such that the buckle pin abuts against the outer wall of the bottom frame.

6. The golf bag able to be disassembled and assembled freely according to claim 4, wherein a method of disassembling the golf bag comprises the following steps:

pressing the second hook of the outer wall of the bottom frame;

snapping the buckle pin;

disassembling the cloth ear;

taking out the supporting stick;

pressing the first hooks of the upper end and lower end of the bag body portion; and separating the head frame, the bag body portion and the bottom frame.

7. The golf bag able to be disassembled and assembled freely according to claim 1, wherein two sides of the reinforcing wall of the head frame are provided with two lugs, which are connected to a back strap respectively.

* * * * *